United States Patent [19]

Taylor

[11] Patent Number: 4,877,291

[45] Date of Patent: Oct. 31, 1989

[54] RECLINING CHAIR

[76] Inventor: William P. Taylor, 244 Lamplighter Cir., Winston-Salem, N.C. 27106

[21] Appl. No.: 265,695

[22] Filed: Nov. 1, 1988

Related U.S. Application Data

[63] Continuation-in-part of Ser. No. 132,317, Dec. 14, 1987, abandoned.

[51] Int. Cl.[4] ..... A47C 1/02

[52] U.S. Cl. ..... 297/321; 297/342; 297/322; 297/300

[58] Field of Search ..... 297/300, 342, 321, 320, 297/322

[56] References Cited

U.S. PATENT DOCUMENTS

| | | | |
|---|---|---|---|
| 2,346,629 | 4/1944 | Travers | 297/342 |
| 2,522,246 | 9/1958 | Armstrong | 297/322 |
| 2,611,421 | 9/1952 | Holloway | 297/320 |
| 4,200,332 | 4/1980 | Brauning | 297/300 |
| 4,607,883 | 8/1986 | Tzu-Chun | 297/320 |
| 4,768,829 | 9/1988 | Goldman | 297/342 |

*Primary Examiner*—Francis K. Zugel

*Attorney, Agent, or Firm*—O'Neil and Bean

[57] ABSTRACT

An improved reclining chair including a base frame having spaced arm rests, a back frame pivotally mounted on the arm rest, a seat frame hingedly connected to the back frame at a point below the pivot connection of the back frame to the arm rest and having its front connected by an elongated linkage to the arm rest, the arm rest, elongated link, seat frame and back frame acting as a substantially parallelogram support linkage for the seat, and an elongated fluid spring cylinder having one end pivotally connected to a rigid frame member extending beneath the seat and its other end pivotally connected to the back frame at a point below the hinged seat and back connection and a manually actuated control for locking the spring cylinder at any desired position of the chair between a fully upright and a fully reclined position.

8 Claims, 3 Drawing Sheets

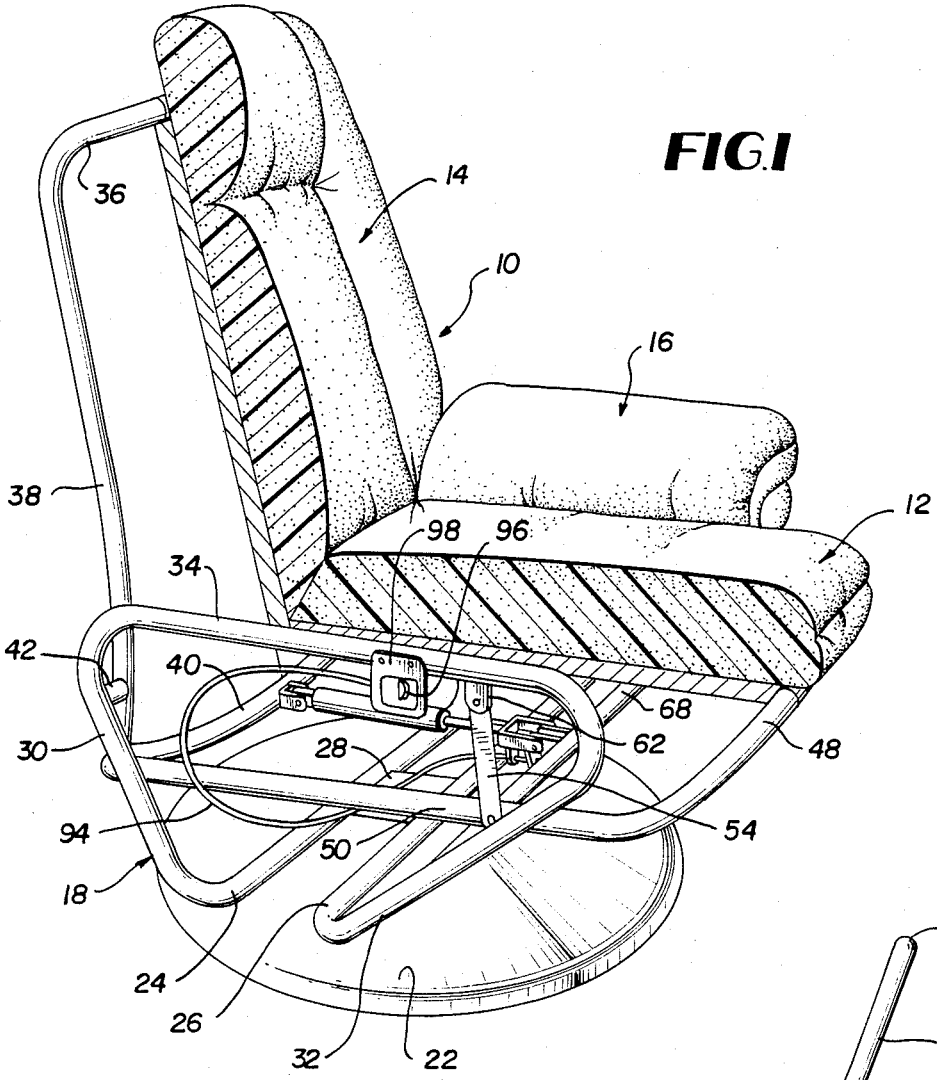
FIG.I
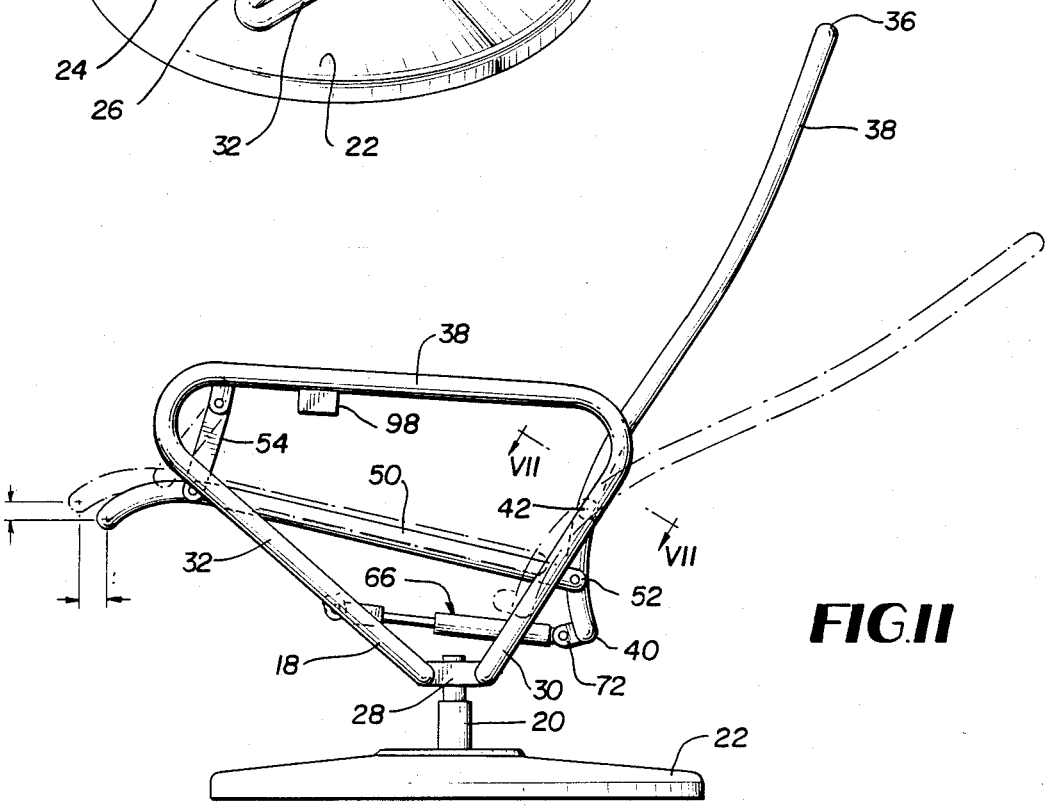
FIG.II

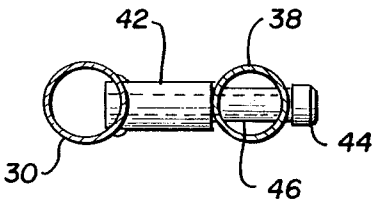
FIG.VII
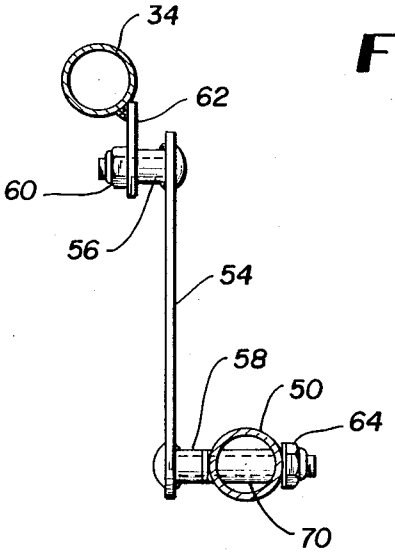
FIG.VI
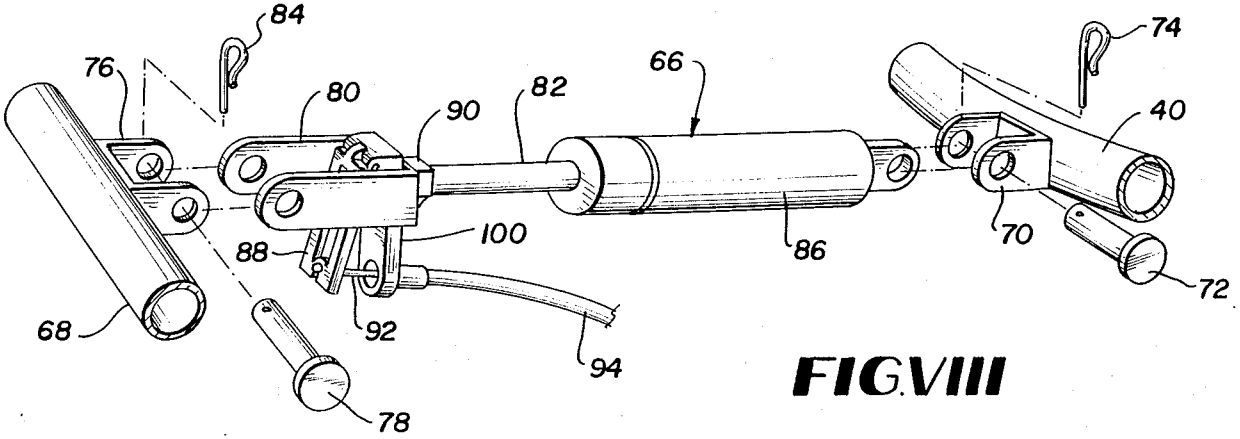
FIG.VIII

FIG. IV
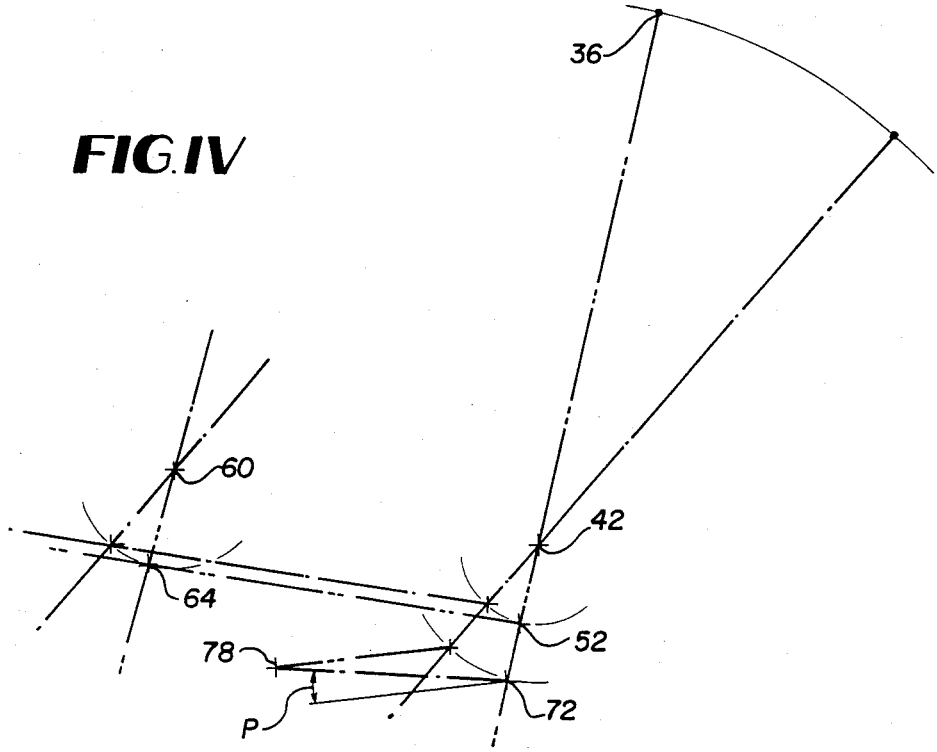
FIG. V
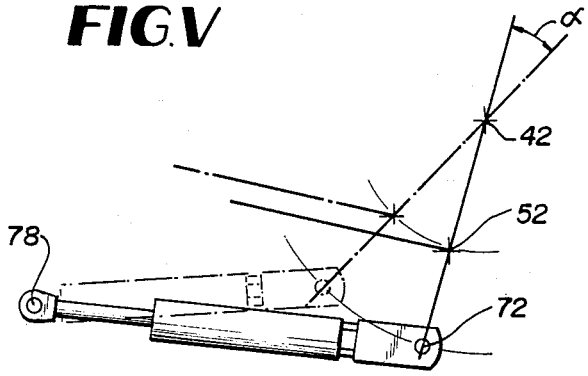
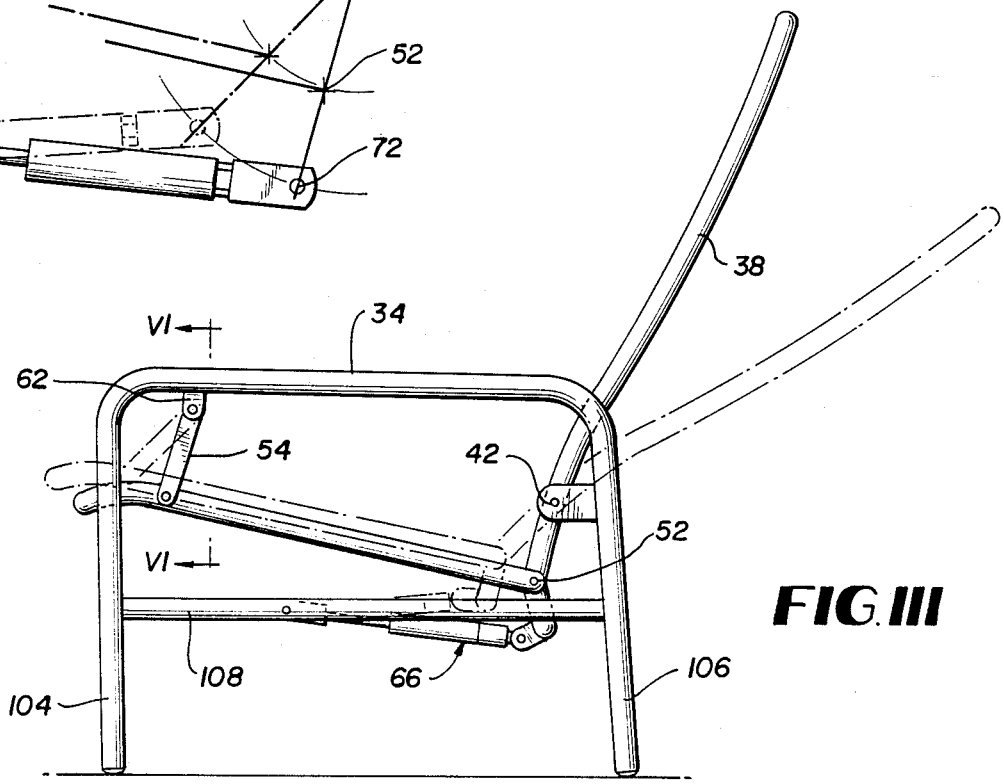
FIG. III

RECLINING CHAIR

RELATED APPLICATION

This is a continuation-in-part of copending application Ser. No. 132,317, filed Dec. 14, 1987, now abandoned.

BACKGROUND OF THE INVENTION

1. Field of the Invention

This invention relates to an adjustable reclining lounge chair, and more particularly to such a chair in which the chair seat and back are supported for simultaneous stepless movement to an infinite number of locked positions between a fully upright and a fully reclined position to provide the desired position of comfort for the chair occupant.

2. The Prior Art

Reclining chairs of various types are well known and have been widely used for many years. One type of reclining chair which has met widespread commercial acceptance employs an articulated linkage mechanism interconnecting and supporting the seat and back on the stationary arm frame to produce complex movement of the seat and back upon application of force by an occupant's legs and/or arms, in combination with the occupant's weight, to produce the desired position change. Such mechanisms normally support the occupant in the selected position by the non-locking mechanical configuration of the articulated linkage which may be overcome by shifting the weight of or applying force by the occupant.

Another type of reclining chair well known in the industry employs a back pivoted to rigid side frames and having its bottom edge hinged to the back edge of a seat which, in turn, is supported for sliding or rolling movement adjacent its front edge. This type of chair structure is illustrated, for example, in U.S. Pat. No. 2,522,246 and Pat. No. 2,599,079, each of which discloses releasable means for locking the chair in the desired position. U.S. Pat. No. 2,522,246 includes a "shock absorber" type of motion restricter to permit a slower, controlled movement of the chair from one position to another.

U.S. Pat. No, 2,346,629 discloses a reclining chair including a back pivotally supported on rigid side frame members and extending downwardly therefrom to have its lower edge pivotally connected to the rear of a seat frame. The forward portion of the seat frame is supported by a pivoted link extending upward and connected to the rigid side frames so that the seat frame, back frame, rigid side frames and the pivoted link form, in effect, an articulated parallelogram support for the seat. Each joint of the parallelogram includes an adjustable frictione element to provide continuous frictional resistance against movement, which frictional resistance is overcome manually by a person occupying the chair. The friction joints are relied upon entirely to maintain the chair in its selected position of adjustment.

U.S. Pat. No. 2,611,421 discloses a reclining-style seat intended for use on an aircraft or the like, with the back being pivotally supported at each side to a rigid support post and having its bottom edge portion pivotally connected to the rear of the seat frame. The forward portion of the seat frame is supported by an elongated shaft extending through a guide sleeve, and latching means which is spring biased to the locked position may be overcome by a manually operated lever mechanism.

The back frame and seat frame are connected in a manner to permit the back to be folded into overlying position above the seat for storage.

U.S. Pat. No. 4,607,833 discloses a reclining chair mechanism including a back frame pivotally mounted at each side to upwardly extending rigid arm support frame members and having its bottom edge hingedly connected to the rear of a seat frame. The seat frame has its forward edge pivotally connected at each side to a sliding friction block constrained within an upwardly inclined track or tube to permit forward and rearward movement of the chair seat and simultaneous elevation or lowering of the front seat upon pivotal movement of the chair back. Weight of the chair seat and of a person occupying the chair, acting on the friction blocks, resists reclining movement and to hold the chair in the selected reclined position.

U.S. Pat. No. 4,200,332 discloses an adjustable work or office chair including a linkage mechanism interconnecting the back and seat at the back of the chair, with the seat being connected at the front of the chair to the chair frame for limited pivotal movement about a horizontal axis. The linkage mechanism includes a combination mechanical and gas spring, with the gas spring including a control mechanism permitting the seat and back to be reclined about the horizontal support axis at the front of the chair and for limited rocking movement. The front of the chair seat is essentially stationary, with screw fasteners securing the front of the seat to the stationary frame shell.

While fluid cylinders, either alone or in combination with mechanical spring means, have been employed to control or assist in the reclining function of reclining seating units, the known structures employing such fluid cylinders have not been entirely satisfactory for use in a loungetype reclining chair. For example, in the known structures, the fluid cylinders generally have either operated only to control movement of the chair back while the seat portion remained essentially fixed or, due to the manner in which the back pivots are located with reference to the hinge connection between the seat and back, the back pivoting motion would push the occupant uncomfortably forward while only partially reclining the chair. In the case of Pat. No. 4,200,332, a gas spring is employed to permit rocking movement about a preselected reclining position for the chair back in a work station or desk chair and for this purpose appears to disclose a successful application of the gas spring although the structure would not adapt itself to incorporation in a lounge-type chair.

SUMMARY OF THE INVENTION

The foregoing and other disadvantages of the prior art are overcome in accordance with the present invention wherein a manually controlled fluid spring cylinder is employed in a reclining lounge chair to provide an occupant with more stable and comfortable support in any selected reclining position throughout the range of reclination of the chair. Seat and back supporting and mounting geometry, in combination with the mounting arrangement of the controllable balancing and locking mechanism, provide ergonomical advantages to the chair and thereby a more stable and comfortable seat and back relationship throughout the full range of adjustment from the upright to the fully reclined position. This is accomplished by use of a deceptively simple mechanical arrangement of the components, both from the standpoint of structure and operation, and thereby provides substantial economic and esthetic advantages for the chair construction. Further, the chair is easy to operate and provides stepless adjustment throughout an infinite range of positions in which the chair may be securely locked with minimum effort for maximum comfort. The controlled, balanced force applied by the fluid spring cylinder employed in the invention, in cooperation with the seat suspension and the back pivot and hinge connection with the seat, enables the easy operation of the chair with minimum force. Further, motion and positioning of the chair is achieved with minimum influence from the occupant's weight and/or position on the chair throughout the range of adjustment.

The seat suspension and actuating mechanism used in the preferred embodiment of the invention results in minimum seat position change with regard to the comfort position of the arm supports as the chair is reclined throughout its full range of positions. Accordingly, it is the primary object of the present invention to provide an improved reclining lounge chair in which the suspension geometry of the seat and back, in cooperation with a fluid spring cylinder force cooperate to simultaneously deploy the seat and back for reclining and locking into any desired position of comfort selected by the occupant throughout the range of movement of the chair.

DESCRIPTION OF THE DRAWINGS

The foregoing and other features and advantages of the chair will be apparent from the detailed description contained hereinbelow, taken in conjunction with the drawings, in which:

FIG. 1 an isometric view of a chair embodying the present invention, with portions broken away to more clearly illustrate other portions of the chair;

FIG. 2 a side elevation view of the frame structure for the chair shown in FIG. 1;

FIG. 3 is a view similar to FIG. 2 showing an alternate embodiment of the chair;

FIG. 4 is a line diagram schematically illustrating the components of the structure shown in FIGS. 2 and 3 in different positions;

FIG. 5 is an enlarged view of a portion of the diagram shown in FIG. 4, with the structure of a fluid spring cylinder superimposed thereon;

FIG. 6 is an enlarged fragmentary view taken on line 6—6 of FIG. 3;

FIG. 7 is an enlarged sectional view taken on line 7—7 of FIG. ;. and

FIG. 8 an exploded view showing the assembly of the fluid spring cylinder with component of the chair frame structure.

Description of the Preferred Embodiment

Referring now to the drawings in detail, an improved reclining lounge chair according to the present invention is shown in FIG. 1 and designated generally by the reference numeral 10. Chair 10 comprises an upholstered seat 12, an upholstered back 14, and upholstered arms 16, only one of which arms is shown in FIG. 1. Also, portions of the seat 12 and back 14 are broken away to more clearly show the underlying frame structure. The chair also comprises a rigid frame assembly 18 which, in the embodiment shown in FIGS. 1 and 2, is supported for pivotal movement about a vertical support column 20 on a base 22.

Frame 18 comprises a rigid tubular structure including a pair of laterally extending support beams 24, 26 joined as by welding to bearing plate 28 mounted on post 20. Beam 24 has its end portions extending upwardly at each side of the chair to define a pair of rear arm rest support posts 30 located one at each side of the chair and beam 26 has its end portions extending upwardly t define forward arm rest support posts 32. The posts 30, 32 on each side of the chair are integrally joined by a horizontally extending arm rest support member 34. In the finished chair, the rear post 30 and forward post 32, and the arm rest support member 34 will be concealed by upholstery as is apparent from FIG. 1.

The upholstered back 14 is supported by a rigid tubular frame assembly including a top member 36, opposed spaced side members 38 and a downwardly curved bottom member 40, with the top 36, bottom 40, and the two side members 38 being joined in a closed generally rectangular loop supported on posts 30 for limited pivotal movement about a horizontal axis. As shown in FIG. 7, the pivotal mounting includes an internally threaded sleeve 42 rigidly welded on rear post 30 for receiving a threaded bolt 44 extending through a reinforcing sleeve 46 mounted, as by welding, in an opening in each back frame member 38.

The upholstered seat 12 is supported by a tubular frame structure which is generally U-shaped in top plan view and consists of a front member 48 and two parallel side members 50. The rear ends of seat side members 50 are pivotally connected to back frame members 38, as at 52, by a pivot assembly similar to that shown in FIG. 8, but employing a shorter internally threaded sleeve 42 so that the rearwardly extending ends of members 50 project between rear posts 30 and back frame members 38.

The front portion of the seat 12 is supported by an elongated pivoted link 54 from the forward end of arm rest member 34. As best seen in FIG. 6, link 54 has a pair of short, tubular sleeve reinforcing members 56, 58 mounted one adjacent each end and on opposite sides of link 54, and a first threaded fastening member 60 extends through sleeve 56 and through an opening in a downwardly extending support bracket 62 rigidly welded on arm rest 34. A second threaded fastener member 64 extends through sleeve 58 and through a reinforcing sleeve 70 in seat side member 50 whereby forward or rearward movement of the seat assembly produces swinging movement of the link 54 about the parallel horizontal axes of threaded fasteners 60 and 64. Thus, as clearly seen in FIG. 2, the arm rests 34, links 54, seat side members 50 and the portion of the back side members 38 between pivots 42 and 52 constitute an articulated support generally in the form of a parallelogram permitting the seat 14 to pivot about pivot point 42 and shift the seat support frame between the solid line and broken line positions shown in FIG. 2. Movement between these extreme positions is controlled by a fluid spring cylinder control assembly indicated generally by the reference numeral 66.

As best seen in FIGS. 1 and 8, a spring assembly 66 has its cylinder end pivotally connected to the center of back frame member 40 by a connecting bracket 70 rigidly welded on member 40 and by a pin 72. A spring pin 74 is employed to retain the pivot pin 72 in position connecting the fluid spring assembly to the bracket 70. A similar bracket 76 is rigidly connected as by welding to the center of an elongated frame member 68 extending between posts 32, and a second connecting pin 78 extends through openings in bracket 76 and in a clevis 80 mounted on the end of rod 82 of the spring assembly 66. A second spring pin 84 releasably retains the coupling pin 78 in position.

The fluid spring assembly 66 is of known construction and one such device which is particularly suited for use in the chair of this invention is manufactured by Gas Spring of America and employs compressed air or other gas in the fluid cylinder. A fluid spring cylinder of this type is illustrated in FIG. 8, and includes a coil type compression spring disposed within the cylinder 86 and acting on a piston (now shown) on the end of rod 82 to normally urge the rod to the extended position tending to rotate the back 14 to the upright position as seen in FIG. 2. Flow of fluid from one end of cylinder 84 to the other is controlled by a valve actuating pin (not shown) extending through rod 82 and bearing upon a pivoted actuating lever 88 mounted on the clevis assembly 80. The clevis 80 and valve control lever are mounted by suitable means such as nut 90 on the end of rod 82. A control cable 92 extending through a flexible tubular sleeve 94 has one end connected to actuating lever 88 and its other end connected to a manually controlled release lever 96 mounted within a recess in a rigid plate 98 on one arm support member 34. Sleeve 94 has one end connected to a rigid arm 100 on clevis assembly 80 and its other end connected to plate 98 to guide cable 92 through a path of fixed length so that movement of the control lever 96 actuates lever 88 to permit easy control of the fluid spring assembly 66 by a person occupying the chair. Releasing the control lever 96 permits fluid pressure in the cylinder 86 to close the internal valve and lock the cylinder in any position of adjustment from the fully reclined and the upright positions.

Referring now to FIG. 3 of the drawings, an alternate embodiment of the invention is illustrated wherein the base 22 and pivot post 20 have been eliminated, and the arm rests 34 are supported on substantially vertical, floor engaging legs 104, 106. Fore-and-aft reinforcing members 108 extending between legs 104 and 106 support the transverse structural member 68 for mounting the fluid spring assembly 66. This embodiment of the invention is otherwise identical to that described above and merely illustrates the versatility of the invention and its adaptability to various styles and designs.

Referring now to FIGS. 2–5, the geometric configuration and relative dimensions of the structural components of a preferred embodiment of the invention and the manner in which these components function together to provide the desired ergonomics and comfort will be described. First, as is apparent from FIGS. 2 and 3, the comfort position of the seat remains substantially unchanged with respect to the height of the arm rest throughout movement of the chair between the full upright position shown in solid lines and the fully reclined position shown in broken lines. Also, only minimal horizontal shift in the seat is provided to maintain the desired comfort position at the juncture of the seat and back cushions, and the seat remains at a substantially constant angle relative to the horizontal throughout its full reclining movement. This substantially fixed attitude of the seat is made possible by the articulated parallelogram-type seat support; however, as is more fully explained hereinbelow the geometry of the linkage results in relative movement of the seat and back which provides a substantially more stable and comfortable seating that has been available from the prior art parallelogram support mechanisms for reclining chair seats.

A commercially designed embodiment of the chair, illustrated in FIGS. 1 and 2, employs a back frame height from the pivot point 42 to the top of frame member 36 of 24 inches and the distance from the pivot point 42 to the seat back hinge pivot 52 is 3¼ inches while the distance from the back pivot 42 to the fluid spring cylinder pivot connection 72 is 5 15/16 inches. A fluid spring cylinder having a stroke of 2.52 inches is employed, and pivot point 78 is located to provide a maximum pivot angle $\alpha$ of the back frame about point 42 of 30° between the fully upright and fully reclined positions. The length of support arm 54 is 4 inches, which is slightly longer than the distance from back pivot 42 to seat back pivot 52; however, in the fully upright position, suspension arm 54 is disposed at an angle of 24° with respect to the vertical whereas a straight line between points 42 and 52 is inclined at an angle of 15° with respect to the vertical, with the result that the attitude of the seat frame with respect to the horizontal is substantially the same in the fully upright and fully reclined positions. It is noted that in the schematic illustrations of FIGS. 4 and 5, a straight line extending through points 72, 5 and 42 is employed to represent the back frame although it is apparent from FIGS. 2 and 3 that the back frame, when viewed in side elevation, is slightly curved above back frame pivot 42. This curvature is compensated for by the padding and upholstery in the finished chair however, so that the geometric representations of FIGS. 4 and 5 are accurate.

Referring still to FIGS. 4 and 5, it is seen that the line of action of the fluid spring assembly 66 in the fully upright position, i.e., a line through point 72 and 78, is inclined at an angle with respect to the horizontal so that the included angle between pivot points 78, 72 and 42 is an obtuse angle.

In the commercial design described above, fluid spring cylinder 66 having a stroke of 2.52 inches is inclined 10.5° with respect to the horizontal so that the obtuse angle described (angle 64, 52, 42) is 94.5° when the chair is in the upright position. When the chair is moved to the fully reclined position, the chair back makes an angle of 45° with respect to the vertical and the longitudinal axis of the fluid spring cylinder is rotated about pivot point 78 through an angle of 9° so that this obtuse angle is increased to 133.5°. This results in a substantial reduction in the lever arm of the fluid spring cylinder, i.e., the distance from the line of action of the cylinder to point 52, in the reclined position, and a consequent compensation for the increased force of the spring resisting the reclining movement as the chair back moves from the upright to the reclined position. This substantially improves control of the reclining action by a person occupying the chair and provides a smoother reclining motion. In addition, the reduced spring action force resulting from the pivoting action of the assembly 66 reduces the tendency of the chair back to snap back toward the upright position upon release of the fluid spring cylinder control mechanism described above. The geometry of the seat and back support, in combination with the mounting and construction of the fluid spring cylinder, cooperate in providing the desired ergonomics and comfort of the improved chair.

While specific dimensions for a commercially designed chair have been given hereinabove, it should be understood that such dimensions may be varied provided the dimensional and angular ratios are retained within an acceptable range. For example, to enable the chair back to recline 30°, and with the line of action of the fluid spring cylinder in the upright position making an angle within the range of about 90° to 100° with the chair back, the ratio of the fluid spring cylinder stroke to the distance between its connection with the chair back and the chair back pivot should be no less than about 1 to 2.5. It should be apparent, of course, that the stroke of the fluid spring cylinder limits the position of the back both in the upright an in the fully reclined positions and the overall length of the fluid spring assembly should be small relative to the total travel to thereby provide the desired pivotal and force movement and consequent shift in its line of action.

In order to maintain the desired comfort position of the seat relative to the chair's arm rest, the seat suspension linkage is dimensioned to maintain the seat in substantially the same attitude throughout the reclining movement of the chair, to produce minimum vertical movement of the seat to maintain leg comfort for the occupant, and to maintain the height of the seat relative to the arm rests within a relatively narrow comfortable range.

It is also important to maintain the ratio of the distance between back pivot 42 and hinge pivot 52 to the distance between back seat pivot and fluid spring cylinder pivot 72 within a range which will allow the chair back to pivot between the upright and reclining positions with minimal assistance of the fluid spring cylinder and with minimum influence from the occupant's weight on the chair seat. The dimensions of the seat suspension linkage also influence relative back and seat position as well as seat elevation changes. In order to provide the desired ergonomics and to maintain occupant comfort, the ratio of the distances between back pivot 42 and seat hinges 52 to the distance from pivot 42 and pivot 72 should be within the range of about 0.5 to about 0.6.

While reference has frequently been made to movement of the chair between the fully upright and fully reclined positions, it should be apparent that control mechanism provided enables adjustment of the chair to a infinite number of positions between these extremes by the convenient fingertip control on the chair arm rest which acts to releasably lock the fluid spring cylinder in any desired position of adjustment between its limits of movement. The seat support geometry is such that the chair is easily retained in its selected reclining position due to the minimal influence of the occupant's weight and to the mechanical leverage of the fluid spring cylinder assembly 66.

Another important feature of the chair structure is the mounting of the fluid spring cylinder in an easily accessible position beneath the seat. The removable pin connection for the assembly enables the chair owner to readily remove the fluid spring cylinder for repair and/or replacement.

While preferred embodiments of the invention have been disclosed and described, it should be apparent that the invention is not so limited and it is therefore intended to include all embodiments of the invention which would be apparent to one skilled in the art and which comes within the spirit and scope of the invention.

WHAT IS CLAIMED IS:

1. In a reclining chair including a base frame having spaced arm rest members disposed one at each side of the chair and at least one laterally extending cross frame member rigidly connecting said arm rest members, a generally U-shaped seat frame having a front and opposed side members, a generally rectangular back frame having a top, a bottom, and opposed side members, pivot means mounting said back frame side members one on each of said arm rest members, hinge means pivotally connecting said seat side members to said back side members at points spaced below said pivot means and above said back frame bottom member, a pair of elongated link members having one end pivotally connected one to each of said arm rest members above said seat frame and the other end connected one to each of said seat frame side members, the improvement comprising elongated fluid spring cylinder means having a first pin means pivotally connecting one end of said fluid spring cylinder means to a cross frame member beneath said seat frame at a position substantially equally spaced between said arm rest members, second pin means pivotally connecting the other end of said fluid spring cylinder to said back frame bottom member at a point substantially equally spaced between said back frame side members, said fluid spring cylinder normally urging said back frame to a full upright position and being compressible upon application of force to the chair back frame to move the chair back frame to a fully reclined position, the fluid spring cylinder having a predetermined fixed stroke which prevents pivotal movement of the seat back frame beyond the fully upright and fully reclined positions, the ratio of the distance of said hinge means below said pivot means to the distance of said second pin means below said pivot means is within the range of about 0.5 to about 0.6, and control means supported on one of said arm rest members and connected to said fluid spring cylinder, said control means being manually operable to selectively lock said air spring cylinder in any position of adjustment of the seat back frame between the fully upright and fully reclined position.

2. The invention defined in claim 1 wherein the ratio of the stroke of the fluid spring cylinder to the distance between said pivot means and said second pin means is at least about 1 to 2.5.

3. The invention defined in claim 2 wherein the attitude of said seat frame relative to the horizontal is substantially the same throughout movement from the fully reclined position to the full upright position.

4. The invention defined in claim 1 wherein the longitudinal axis of said elongated fluid spring cylinder is disposed at an obtuse angle relative to a line extending between said pivot means and said second pin means when said back frame is in the full upright position.

5. The invention defined in claim 4 wherein the location of said first and said second pin means relative to said pivot means results in said obtuse angle being increased continuously during movement of said back frame from the full upright position t the fully reclined position to thereby progressively reduce the distance between said pivot means and the longitudinal axis of said fluid spring cylinder.

6. The invention defined in claim 5 wherein the ratio of the stroke of the fluid spring cylinder to the distance between said pivot means and said second pin means is at least about 1 to 2.5.

7. The invention defined in claim 6 wherein the location of said first and said second pin means relative to said pivot means results in said obtuse angle being increased continuously during movement of said back frame from the full upright position to the fully reclined position to thereby progressively reduce the distance between said pivot means and the longitudinal axis of said fluid spring cylinder.

8. The invention defined in claim 7 wherein the attitude of said seat frame relative to the horizontal is substantially the same in the fully reclined and the full upright position.

* * * * *